US007576718B2

(12) United States Patent
Miyazawa

(10) Patent No.: US 7,576,718 B2
(45) Date of Patent: Aug. 18, 2009

(54) DISPLAY APPARATUS AND METHOD OF DRIVING THE SAME

(75) Inventor: Takao Miyazawa, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 742 days.

(21) Appl. No.: 10/936,649

(22) Filed: Sep. 9, 2004

(65) Prior Publication Data

US 2005/0116902 A1 Jun. 2, 2005

(30) Foreign Application Priority Data

Nov. 28, 2003 (JP) ..... 2003-399339

(51) Int. Cl.
*G09G 3/30* (2006.01)

(52) U.S. Cl. ..... 345/78; 345/76; 345/77; 345/80; 345/81; 345/82; 345/204

(58) Field of Classification Search ..... 345/78, 345/76–77, 80–82, 204
See application file for complete search history.

(56) References Cited

U.S. PATENT DOCUMENTS

| | | | | |
|---|---|---|---|---|
| 6,476,784 | B2 * | 11/2002 | Zavracky et al. | 345/88 |
| 6,816,144 | B2 * | 11/2004 | Tsuchi | 345/100 |
| 6,989,826 | B2 | 1/2006 | Kasai | |
| 7,057,589 | B2 * | 6/2006 | Shin et al. | 345/82 |
| 7,205,988 | B2 * | 4/2007 | Nakamura et al. | 345/207 |
| 2003/0122813 | A1 | 7/2003 | Ishizuki et al. | |
| 2004/0085086 | A1 * | 5/2004 | LeChevalier | 324/770 |
| 2004/0227749 | A1 | 11/2004 | Kimura | |
| 2006/0114192 | A1 | 6/2006 | Kasai | |

FOREIGN PATENT DOCUMENTS

| | | |
|---|---|---|
| EP | 1 130 565 A1 | 9/2001 |
| JP | A 2003-043993 | 2/2003 |
| JP | A 2003-114645 | 4/2003 |
| JP | A 2003-157050 | 5/2003 |
| JP | A 2003-202837 | 7/2003 |
| JP | A 2003-216109 | 7/2003 |
| JP | A 2004-252419 | 9/2004 |
| WO | WO 01/006484 | 1/2001 |

* cited by examiner

*Primary Examiner*—Richard Hjerpe
*Assistant Examiner*—Leonid Shapiro
(74) *Attorney, Agent, or Firm*—Oliff & Berridge, PLC

(57) ABSTRACT

To provide a technology for preventing effect of precharging from becoming nonuniform when the threshold voltage of a driving transistor included in a current drive type pixel circuit is nonuniform. In the technology, before setting the internal state of each of current drive type pixel circuits, provided to corresponded to intersections of a plurality of data lines and a plurality of scanning lines, in accordance with light emission grayscales, precharge voltages as voltages to be applied to the data lines are specified. A predetermined current is supplied to the current drive type pixel circuits via the data lines. A precharge voltage is specified in accordance with voltages appearing in the data lines after the predetermined current is supplied.

2 Claims, 14 Drawing Sheets

PRIOR ART

PRIOR ART

PRIOR ART

DISPLAY APPARATUS AND METHOD OF DRIVING THE SAME

BACKGROUND OF THE INVENTION

1. Field of Invention

The present invention relates to technology of setting the internal state of a current drive type pixel circuit corresponding to light emission grayscales for the current drive type pixel circuit at a high speed.

2. Description of Related Art

In recent years, an electro-optical apparatus using an organic electroluminescent (EL) element has been progressively developed. The organic EL element is a self-luminous element and does not require a backlight. Accordingly, a display apparatus using the organic EL element is expected to achieve low power consumption, a wide viewing angle, and a high contrast ratio. In this specification, the term "electro-optical apparatus" means an apparatus that converts electrical signals into light. The electro-optical apparatus normally converts electrical signals representing an image into light representing the image and is particularly suitable to implementation of a display apparatus.

FIG. 13 is a block diagram of a conventional display apparatus using an organic EL element. The conventional display apparatus includes a display matrix section (hereinafter, referred to as a "display region") 120, a scanning line driver 130, and a data line driver 140. The display matrix section 120 includes a plurality of pixel circuits 110 arranged in a matrix. Each pixel circuit 110 includes an organic EL element 220. Each of the pixel circuits 110 arranged in a matrix is connected to one of a plurality of data lines Xm (where m=1, 2, . . . , and M) extending in a column direction and is connected to one of a plurality of scanning lines Yn (where n=1, 2, . . . , and N) extending in a row direction.

FIG. 14 is a circuit diagram illustrating an example of the pixel circuit 110. The pixel circuit 110 is located at an intersection of an m-th data line Xm and an n-th scanning line Yn. The scanning line Yn includes two sub-scanning lines V1 and V2. The pixel circuit 110 is a current drive type circuit that controls a light emission grayscale of the organic EL element 220 corresponding to a current flowing in the data line Xm. In detail, the pixel circuit 110 further includes four transistors 211 to 214 and a storage capacitor 230 in addition to the organic EL element 220. The storage capacitor 230 stores charges corresponding to data signals received via the data line Xm to control the light emission of the organic EL element 220 using the stored charges. In other words, the storage capacitor 230 stores a voltage corresponding to the current flowing in the data line Xm. The first to third transistors 211 to 213 are n-channel field effect transistor (FET) and the fourth transistor 214 is a p-channel FET. The organic EL element 220 is a current drive type light emission element like a photodiode and is thus marked with a symbol of a diode in the drawings.

The source of the first transistor 211 is connected the drain of the second transistor 212, the drain of the third transistor 213, and the drain of the fourth transistor 214. The drain of the first transistor 211 is connected to the gate of the fourth transistor 214. The storage capacitor 230 is connected between a source and the gate of the fourth transistor 214. The source of the fourth transistor 214 is connected to a power supply voltage Vdd.

The source of the second transistor 212 is connected to the data line driver 140 via the data line Xm. The organic EL element 220 is connected between the source of the third transistor 213 and a ground voltage. The gate of the first transistor 211 and the gate of the second transistor 212 are commonly connected to the first sub-scanning line V1. The gate of the third transistor 213 is connected to the second sub-scanning line V2.

The first and second transistors 211 and 212 are switching transistors used to accumulate charges in the storage capacitor 230. The third transistor 213 is a switching transistor that is in an ON state during the light emission of the organic EL element 220. The fourth transistor 214 is a driving transistor that controls a value of current flowing in the organic EL element 220. The current value in the fourth transistor 214 is controlled by the amount of charges stored (i.e., accumulated) in the storage capacitor 230.

FIG. 15 is a timing chart illustrating the normal operation of the pixel circuit 110. In FIG. 15, a voltage in the first sub-scanning line V1 (hereinafter, referred to as a first gate signal V1), a voltage in the second sub-scanning line V2 (hereinafter, referred to as a second gate signal V2), a current in the data line Xm (hereinafter, referred to as data signals Iout), and a current IEL in the organic EL element 220 are represented.

A driving period Tc is divided into a programming period Tpr and a light emission period Tel. The driving period Tc is a period of time taken to update a light emission grayscale of each of the organic EL elements 220 within the display matrix section 120 one time. The driving period Tc is referred to as a frame period. A grayscale update is performed in a group of pixel circuits in a single row at one time and is sequentially performed in N groups of pixel circuits in the N rows during the driving period Tc. For example, when the grayscale update is performed on all of the pixel circuits 110 at 30 Hz, the driving period Tc is about 33 ms.

The programming period Tpr is a period of time while the light emission grayscales of each organic EL element 220 is set in a corresponding pixel circuit 110. Here, programming indicates the operation of setting the light emission grayscale in the pixel circuit 110. For example, when the driving period Tc is about 33 ms and the total number N of the scanning lines Yn is 480, the programming period Tpr is less than about 69 μs.

During the programming period Tpr, the second gate signal V2 is set to a "low" level and the third transistor 213 remains turned off. Next, a current Im corresponding to the light emission grayscale flows in the data line Xm, the first gate signal V1 is set to a "high" level, and the first and second transistors 211 and 212 are turned on. Here, the data line driver 140 functions as a constant current source that provides the current Im according to the light emission grayscale.

Charges corresponding to the current Im flowing in the fourth transistor 214 (i.e., the driving transistor) are stored in the storage capacitor 230. As a result, a voltage stored in the storage capacitor 230 is applied between the source and the gate of the fourth transistor 214. Hereinafter, the current Im of data signals used in the programming is referred to as a "programming current Im". After the programming is finished, the scanning line driver 130 sets the first gate signal V1 to the "low" level and turns off the first and second transistors 211 and 212. The data line driver 140 stops outputting the data signals Iout.

During the light emission period Tel, while the first gate signal V1 remains at the "low" level, the first and second transistors 211 and 212 remain turned off, the second gate signal V2 is set to the "high" level and the third transistor 213 is turned on. Since the voltage corresponding to the programming current Im has been stored in the storage capacitor 230, almost the same current as the programming current Im flows in the fourth transistor 214. Therefore, almost the same current as the programming current Im flows in the organic EL element 220. The organic EL element 220 emits light with a grayscale corresponding to the current value Im.

In the display apparatus illustrated in FIG. 13, the light emission of the organic EL element 220 included in each pixel circuit 110 is controlled according to the above-described sequence of operation. However, when a large display panel is manufactured using the above-described structure, the capacitance (Cd) of each data line increases and a large amount of time is required to drive the data lines. To solve these problems, "Patent Document 1" discloses technology for accelerating charge or discharge by writing the power supply voltage Vdd in the data line Xm connected to the pixel circuit 110 before programming a current corresponding to the light emission grayscale in the pixel circuit 110, that is, before setting an internal sate of the pixel circuit 110. Hereinafter, the operation of programming a predetermined voltage in a data line connected to a current drive type pixel circuit before the internal state of the pixel circuit is set corresponding to the light emission grayscale of the pixel circuit, thereby accelerating the charge or discharge, which is referred to as "precharging". A voltage written in the data line by the precharging is referred to as a "precharge voltage".

[Patent Document 1] Pamphlet of PCT Publication WO 01/006484

SUMMARY OF THE INVENTION

When it is assumed that a driving transistor in each pixel circuit 110 operates in a saturation region, a current "Ids" flowing between a drain and the source of the driving transistor (i.e., a current flowing in the organic EL element 220) is given by the following equation:

$$Ids=(\mu p\cdot\in\cdot Wp)/(2\cdot tox\cdot Lp)(Vgs-Vth)^2, \quad \text{[Expression 1]}$$

where Vgs denotes a voltage flowing between the gate and the source, Vth denotes a threshold voltage, Wp denotes a channel width, Lp denotes a channel length, μp denotes a hole mobility, tox denotes the thickness of a gate insulation layer, and ∈ denotes a dielectric constant of a gate insulation material.

When the threshold voltage Vth of the driving transistor is different from the pixel circuits 110, even though the organic EL elements 220 emit light with the same grayscale, a voltage to be written in the storage capacitor 230 is different from the pixel circuits 110. When a voltage to be written in the storage capacitor 230 is different from the pixel circuits 110, an optimal precharge voltage to be applied to a data line before the voltage is written in the storage capacitor 230 is also different from the pixel circuits 110. To solve this problem, the technology disclosed in Patent Document 1 always uses the power supply voltage Vdd as the precharge voltage. Accordingly, a satisfactory effect by the precharging cannot be obtained in this technology disclosed in Patent document 1. In detail, referring to FIG. 16, when a precharge voltage Vp is much higher or lower than an optimal voltage Vopt, a voltage stored in the storage capacitor 230 (i.e., the gate voltage of the driving transistor) is non-uniform even after the programming period Tpr lapses. When the gate voltage of the driving transistor is not uniform, a current flowing in the organic EL element 220 becomes nonuniform and the light emission grayscale of each organic EL element 220 becomes nonuniform. In other words, the quality of a displayed image may deteriorate. The deterioration of the quality of a displayed image is particularly prominent when the organic EL element 220 emits light with a low grayscale. When the organic EL element 220 emits light with the low grayscale, since a current corresponding to the low grayscale is small, it takes long to write a voltage corresponding to the current in the storage capacitor 230, and therefore, the programming of the voltage may not be satisfactorily performed during the programming period Tpr, which is referred to as "insufficient programming" hereinafter.

In view of the foregoing, it is an object of the present invention to provide a technology for preventing effect of precharging from becoming nonuniform when the threshold voltage of a driving transistor included in a current drive type pixel circuit is nonuniform.

To accomplish the above object, the present invention provides a display apparatus including a plurality of data lines; a plurality of scanning lines; a plurality of current drive type pixels provided to corresponded to intersections of the plurality of data lines and the plurality of scanning lines; supplying means which supplies a predetermined current via the plurality of data lines to the corresponding pixels; and specifying means which specifies precharge voltages as voltages to be applied to the data lines connected to the pixels before the internal state of the pixels corresponding to light emission grayscales is set, in accordance with voltages appearing in the data lines after the supplying means provides the predetermined current.

According to the display apparatus, the precharge voltages are specified in accordance with the voltages appearing in the data lines when the internal state of the pixels corresponding to the predetermined current is set. That is, the precharge voltages are specified when the pixels are actually operated. Accordingly, if precharging is performed using the thus specified precharge voltages, a precharging effect is uniform even when the threshold voltage of a driving transistor included in each pixel is not uniform.

In a more preferred aspect, the display apparatus may further comprises storage means which stores the precharge voltages specified by the specifying means so as to correspond to the pixels. In the aspect as described above, a precharge voltage specified for each pixel is stored in the storage means to corresponded to the pixel. Generally, in order to accurately specify an optimal precharge voltage, a sufficiently long time for programming is required and is usually longer than the time required to display an image. However, according to the present invention, for example, in factories before forwarding products, a precharge voltage may be specified only one time and stored in the storage means. Accordingly, compared to a case where a precharge voltage is specified whenever an image is displayed, the time required to specify the precharge voltage is reduced.

In a more preferred aspect, the display apparatus may further comprises measuring means which measures the voltages appearing in the data lines after the supplying means provides the predetermined current. The specifying means specifies the voltages measured by the measuring means as the precharge voltages. Since the specified precharge voltages are the voltages appearing in the data line when the pixels are actually driven, a precharging effect is uniform even when the threshold voltage of a driving transistor included in a pixel is not uniform.

In a more preferred aspect, the supplying means supplies the predetermined current to the pixels at least when electric power is applied to the display apparatus. Since the precharge voltage for each pixel is specified when electric power is supplied to the display apparatus, even when a driving transistor included in the pixel is degraded over time and has a threshold voltage changed, the precharge voltage is specified in accordance with the changed threshold voltage.

In a more preferred aspect, the predetermined current supplied to the pixels by the supplying means corresponds to a current when the pixels are caused to emit light with a low grayscale. Generally, a programming current corresponding to the low grayscale becomes small, resulting in an insufficient programming problem. However, if precharge voltages are specified in accordance with to voltages appearing in data lines when the internal state of pixels is set using the current corresponding to the low grayscale, the insufficient programming problem can be avoided.

In a more preferred aspect, the display apparatus may further comprises a display region in which the plurality of pixels is arranged in a matrix. The supplying means supplies the predetermined current to all the pixels arranged in the display region. The specifying means specifies the precharge voltages for all the pixels. In above-described aspect, the precharge voltages for all the pixels arranged in the display region are specified through the actual operation of each pixel. Accordingly, a precharging effect is uniform even when the threshold voltage of a driving transistor included in the pixel is not uniform.

In a more preferred aspect, the display apparatus may further include a display region in which the plurality of pixels is arranged in a matrix. The supplying means supplies the predetermined current to pixels belonging to a row selected from the display region. The specifying means specifies the precharge voltages for the corresponding pixels supplied with the predetermined current by the supplying means and then specifies the average of the precharge voltages as the precharge voltage for the pixels in the selected row. In above-described aspect, the precharge voltages specified for the pixels belonging to the selected row are equalized in units of rows, and therefore, a calibration error is reduced.

In a more preferred aspect, the display apparatus may further comprise a display region in which the plurality of pixels is arranged in a matrix. The supplying means supplies the predetermined current to pixels belonging to at least one row or column designated in advance in the display region. The specifying means specifies the precharge voltages for the corresponding pixels supplied with the predetermined current and then based on the distribution of the specified precharge voltages, optimizes the precharge voltages for the corresponding pixels arranged in the display region. Here, the time required to specify the optimal precharge voltages can be reduced compared to a case where precharge voltages for all of the pixels are specified by actually driving all of the pixels in the display region. In addition, the storage capacity required for storing the specified precharge voltages can be reduced.

In a more preferred aspect, the display apparatus may further comprise a display region in which the plurality of pixels is arranged in a matrix. The supplying means supplies the predetermined current to calibration pixels disposed outside the display region along sides of the display region, and the specifying means specifies the precharge voltages for the corresponding calibration pixels and then based on the distribution of the specified precharge voltages, optimizes the precharge voltages for the corresponding pixels arranged in the display region. In the above-described aspect, since the calibration pixels are disposed outside the display region along sides of the display region, the specification of optimal precharge voltages and actual image display can be simultaneously performed without affecting the display quality of the display region.

In a more preferred aspect, the calibration pixels may be dummy pixels that do not comprise any light emission element. According to the above-described aspect, since the dummy pixels do not emit light when they are used to specify the precharge voltages, the display quality of the display region is much less affected.

In a more preferred aspect, the display apparatus may further comprise switching means which selects either a first data line or a second data line for being connected to the supplying means. The first data line is connected to the pixels arranged in the display region to display an image, and the second data line is connected to the calibration pixels. The calibration pixels are disposed such that the length of the second data line is smaller than that of the first data line. According to the above-described aspect, since the calibration pixels are connected to data lines other than the data lines connected to the pixels for image display, the floating capacity of the data lines connected to the pixels for image display can be decreased, and therefore, the time required to specify a precharge voltage can be reduced.

In a more preferred aspect, the display apparatus may further comprise temperature detecting means which detects the temperature of the pixels, where the specifying means specifies the precharge voltages based on the voltages appearing in the data lines and the temperature detected by the temperature detecting means. In the above-described aspect, even when the threshold voltage of a driving transistor included in a pixel changes due to an increase in the temperature of the driving transistor during image display, the precharge voltage can be specified in accordance with the changed threshold voltage at that time.

To solve the above object of the present invention, the present provides a method of driving a display apparatus. The method comprises the steps of: a first step of supplying a predetermined current to a plurality of current drive type pixels provided to corresponded to intersections of a plurality of data lines and a plurality of scanning lines via the data lines; and a second step of specifying precharge voltages as voltages to be applied to the data lines connected to the pixels before the internal state of the pixels corresponding to light emission grayscales is set, in accordance with voltages appearing in the data lines after the predetermined current is supplied.

According to the driving method, even when the threshold voltage of a driving transistor included in the pixel is not uniform, a precharge voltage for each pixel is specified when each pixel is actually driven. Accordingly, if precharging is performed using the thus specified precharge voltage, a precharging effect can be uniform.

In a more preferred aspect, the first step may comprise supplying the predetermined current to pixels belonging to at least one row or column designated in advance in a display region in which the plurality of pixels is arranged in a matrix. The second step may comprise specifying a plurality of the precharge voltages for the corresponding pixels supplied with the predetermined current, and then based on the distribution of the specified precharge voltages, optimizing the precharge voltages for the corresponding pixels arranged in the display region.

Here, the time required to specify the optimal precharge voltages can be reduced compared to a case where precharge voltages for all of the pixels are specified by actually driving all of the pixels in the display region. In addition, the storage capacity required for storing the specified precharge voltages can be reduced.

DETAILED DESCRIPTION OF PREFERRED EMBODIMENTS

Hereinafter, preferred embodiments of the present invention will be described in detail with reference to the accompanying drawings.

[A. Structure]

Figure 1:
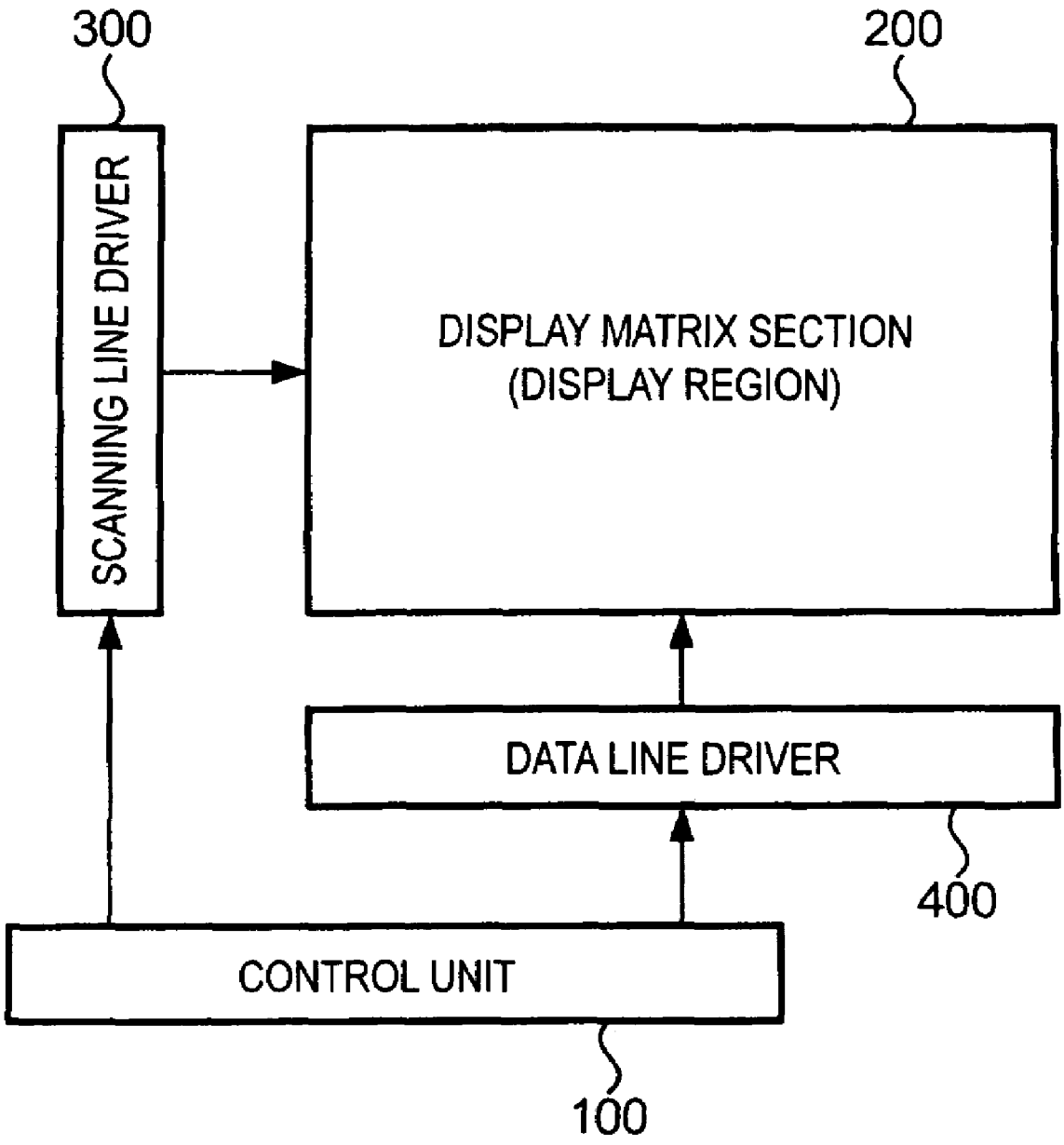
FIG. 1 is a block diagram of a display apparatus according to the present invention.

FIG. 1 is a schematic block diagram of a display apparatus according to an embodiment of the present invention. As shown in FIG. 1, the display apparatus includes a control unit 100, a display matrix section 200, a scanning line driver 300, and a data line driver 400. The control unit 100 generates scanning line driving signals and data line driving signals, which are used to perform a display on the display matrix section 200, and supplies the generated signals to the scanning line driver 300 and the data line driver 400, respectively.

Figure 2:
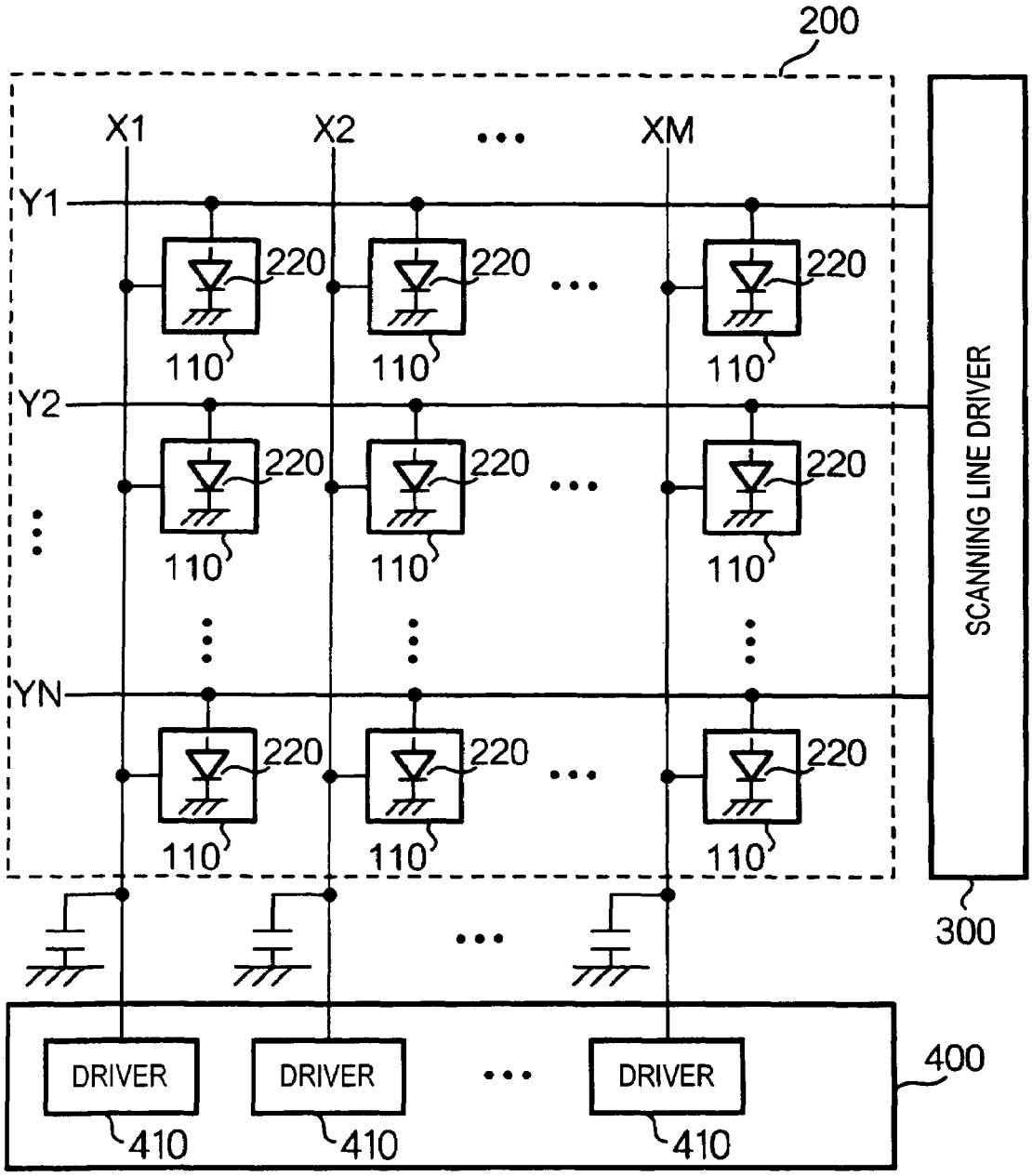
FIG. 2 is a block diagram illustrating the internal structure of a display matrix section and the internal structure of a data line driver according to the present invention.
Figure 14:
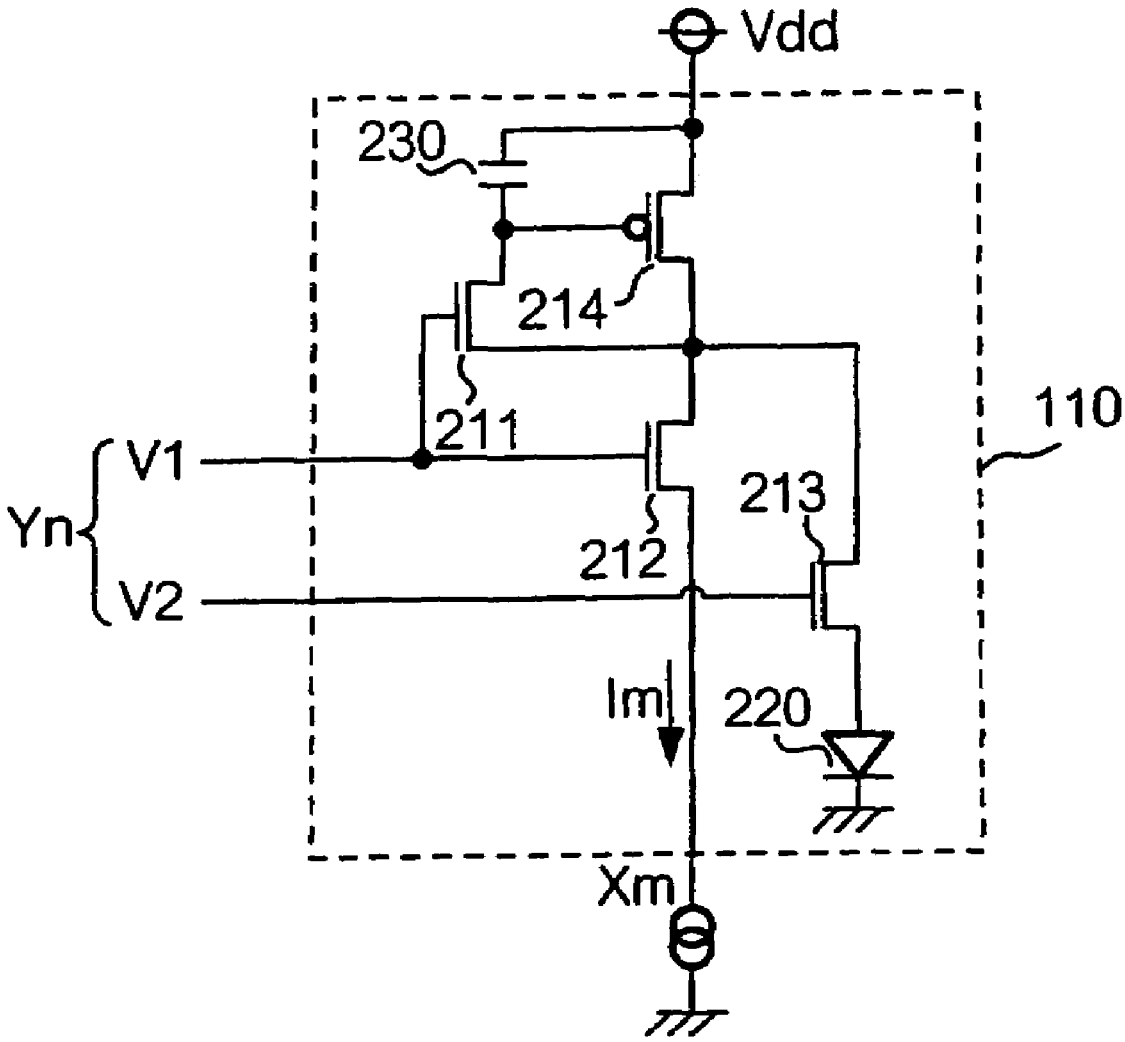
FIG. 14 is a circuit diagram illustrating an example of a pixel circuit 110 of a general display apparatus.
Figure 15:
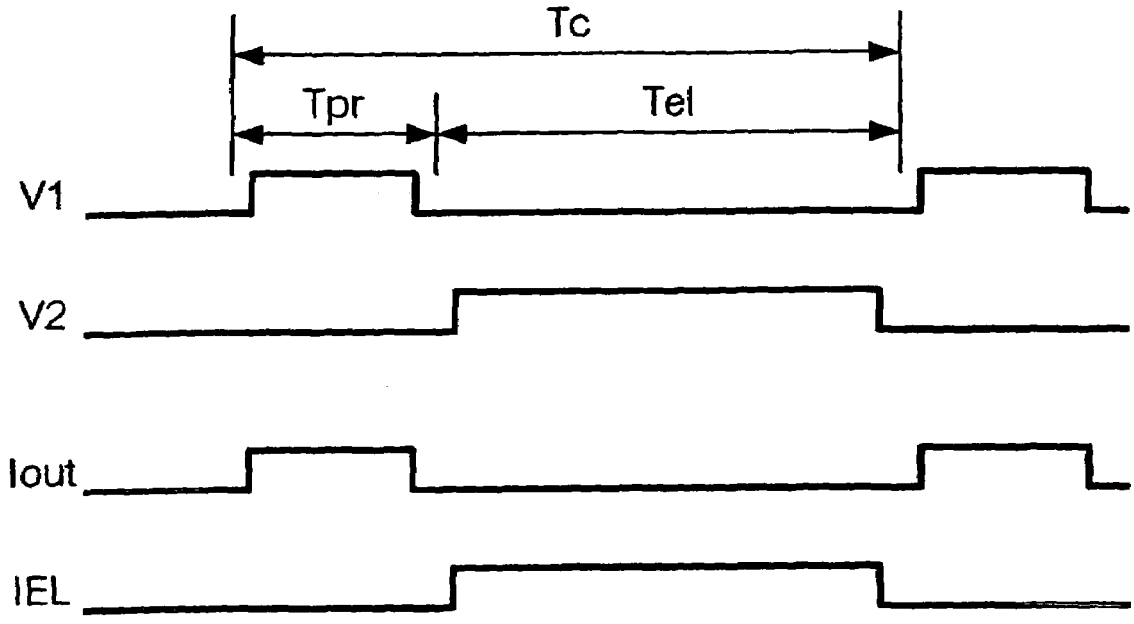
FIG. 15 is a timing chart illustrating the normal operation of the pixel circuit 110 of the general display apparatus.
Figure 16:
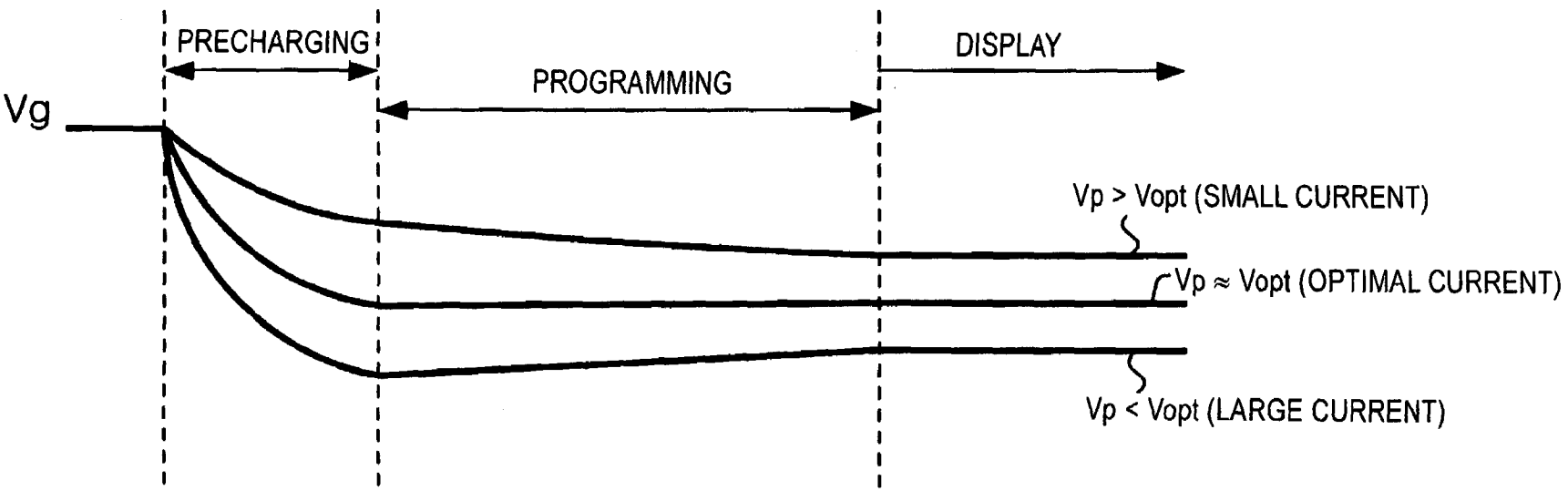
FIG. 16 illustrates effects of different precharge voltages.

FIG. 2 is a block diagram illustrating the internal structure of the display matrix section 200 and the internal structure of the data line driver 400. As shown in FIG. 2, the display matrix section 200 includes a plurality of pixel circuits 110 arranged in a matrix (refer to FIG. 14). Each of the pixel circuits 110 in a matrix is connected to one of a plurality of data lines Xm (where m=1 to M) extending in a column direction, and connected to one of a plurality of scanning lines Yn (where n=1 to N) extending in a row direction. In the present specification, the pixel circuits 110 are referred to as unit circuits or pixels. In the embodiment of the present invention, the pixel circuits 110 arranged in the display matrix section 200 have the same structure as the pixel circuit 110 shown in FIG. 14. However, as far as the pixel circuits arranged in the display matrix section 200 are current drive type pixel circuits, their circuit structure may be changed. In addition, in the embodiment of the present invention, all of the transistors included in the pixel circuits 110 are field effect transistors (FETs). However, some or all of the transistors may be replaced with bipolar transistors or other types of switching devices. For example, silicon-based transistors may be used as this kind of a transistor in addition to the thin film transistors (TFTs).

The control unit 100 shown in FIG. 1 converts display data (i.e., image data) representing a display state of the display matrix section 200 into matrix data representing the light emission grayscale of each of organic electroluminescent (EL) elements 220. The matrix data includes scanning line driving signals sequentially selecting a single group of pixel circuits 110 in a single row and data line driving signals indicating the level of data signals supplied to the organic EL elements 220 in the selected group of the pixel circuits 110. The scanning line driving signals are supplied to the scanning line driver 300 and the data line driving signals are supplied to the data line driver 400. In addition, the control unit 100 controls timing for driving the scanning lines Yn and the data lines Xm.

The scanning line driver 300 selectively drives one of the plurality of scanning lines Yn to select a group of pixel circuits 110 in a single row. The data line driver 400 includes a plurality of single line drivers 410 driving the respective data lines Xm. Each of the single line drivers 410 supplies data signals to a group of pixel circuits 110 in a row via a data line Xm. If the internal state of each of the pixel circuits 110 is programmed according to the data signals, a current flowing in each organic EL element 220 according to the programmed internal state is controlled. As a result, the light emission grayscale of the organic EL element 220 is controlled.

As described above, when the programming of the internal state of each pixel circuit 110 is completed, the gate voltage of a driving transistor included in the pixel circuit 110 appears in a data line Xm connected to the pixel circuit 110. In the embodiment of the present invention, the single line driver 410 has a structure for measuring the voltage appearing in the data line Xm after the programming is completed. A precharge voltage is specified based on the voltage measured by the single line driver 410. As described above, since the precharge voltage specified by the single line driver 410 according to the present embodiment is obtained when the pixel circuit 110 is actually driven, nonuniformity due to a precharging effect is not generated even though the threshold voltage of the driving transistor included in the pixel circuit 110 is not uniform. Hereinafter, the single line driver 410 will be described in detail.

Figure 3:
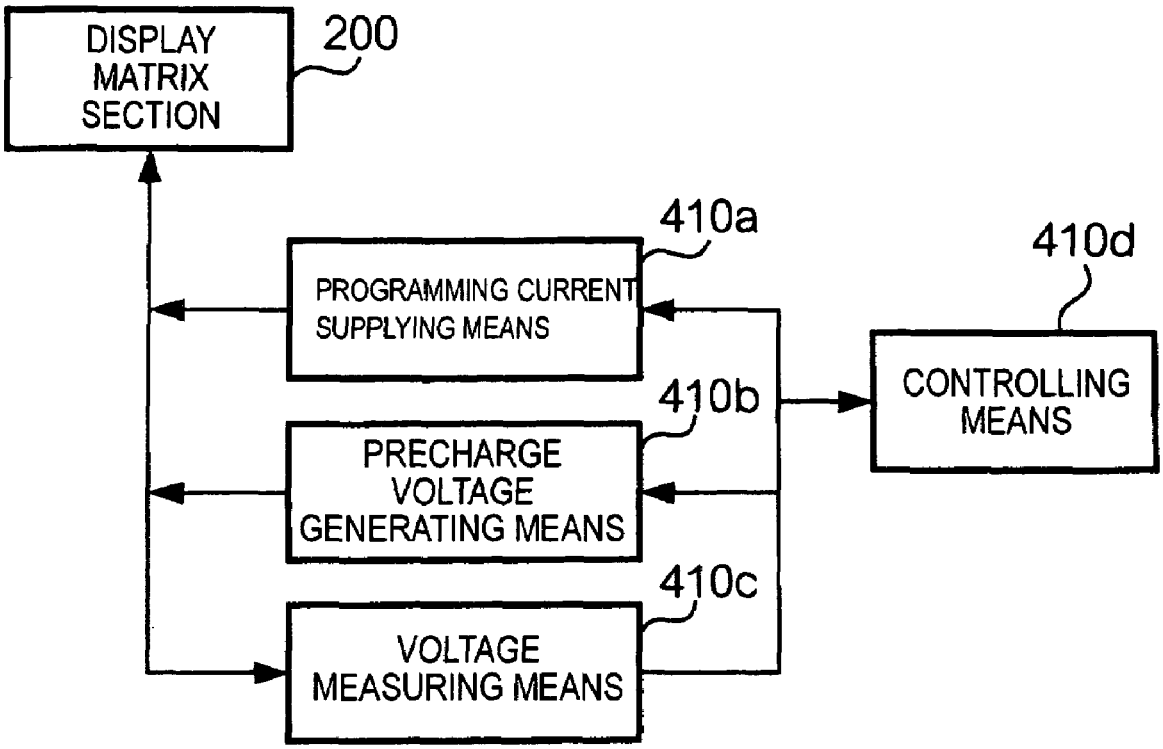
FIG. 3 is a block diagram illustrating a fundamental structure of a single line driver 410 according to the present invention.

FIG. 3 is a block diagram illustrating a fundamental structure of the single line driver 410. The single line driver 410 is implemented by a single integrated circuit (IC) chip and includes programming current supplying means 410*a*, precharge voltage generating means 410*b*, voltage measuring means 410*c*, and controlling means 410*d* for controlling these elements.

The programming current supplying means 410*a* generates a current to be programmed in a pixel circuit 110 and outputs the current to the data line Xm. In detail, the programming current supplying means 410*a* generates a current (hereinafter, referred to as a calibration current) to be programmed in the pixel circuit 110 to specify a precharge voltage or a current used to set the internal state of the pixel circuit 110 and outputs the current to the data line Xm. In the embodiment of the present invention, a current corresponding to a case where the organic EL element 220 is caused to emit light with a low grayscale (for example, having a value of 1-10 when the grayscale ranges from 0 to 255) is used as the calibration current. Since the insufficient programming problem becomes prominent when the internal state of the pixel circuit 110 is set using the current corresponding to the low grayscale, the current corresponding to the low grayscale is used in actually driving the pixel circuit 110 and specifying the precharge voltage to avoid the insufficient programming problem. In the embodiment of the present invention, the current for causing the organic EL element 220 to emit light with the low grayscale is used as the calibration current. However, it is apparent that a current corresponding to a higher grayscale may be used as the calibration current in the present invention. Hereinafter, a process of setting the internal state of the pixel circuit 110 and specifying the precharge voltage using the calibration current is referred to as "calibration".

The voltage measuring means 410*c* measures a voltage appearing in the data line Xm after the calibration current is supplied to the pixel circuit 110 and specifies the precharge voltage for the pixel circuit 110. The precharge voltage generating means 410*b* applies the precharge voltage measured by the voltage measuring means 410*c* to the data line Xm to perform precharging.

The controlling means 410*d* sequentially drives the programming current supplying means 410*a*, the precharge voltage generating means 410*b*, and the voltage measuring means 410*c* in order described below to execute a method of specifying the precharge voltage according to an embodiment of the present invention. In detail, as a first step, the controlling means 410*d* causes the programming current supplying means 410*a* to generate a calibration current to supply the generated calibration current to the pixel circuit 110 via the data line Xm. Next, as a second step, the controlling means 410*d* waits until programming using the calibration current is sufficiently performed and causes the voltage measuring means 410*c* to measure a voltage appearing in the data line Xm as the result of the programming and to specify the measured voltage as the precharge voltage.

Thereafter, when an image is displayed, the controlling means 410*d* causes the precharge voltage generating means 410*b* to apply the specified precharge voltage to the data line Xm and then causes the programming current supplying means 410*a* to output a current corresponding to display data to the data line Xm. In the embodiment of the present invention, the programming current supplying means 410*a*, the precharge voltage generating means 410*b*, and the voltage measuring means 410*c* are incorporated in the single line driver 410. However, it is apparent that those means may be incorporated in the display matrix section 200.

The fundamental structure of the single line driver 410 has been described. An example of a detailed structure of the single line driver 410 will be described with reference to FIG. 4. A current digital-to-analog converter (DAC) 510 in FIG. 4 corresponds to the programming current supplying means 410*a* shown in FIG. 3 and is connected to the data line Xm via a switch S1. A Vp DAC 520 and a Vp data generating means 530 correspond to the precharge voltage generating means 410*b* shown in FIG. 3 and are connected to the data line Xm via a switch S2. The Vp DAC 520 and the Vp data generating means 530 also function as the voltage measuring means 410*c* shown in FIG. 3 together with a comparator 540 whose negative terminal is connected to the data line Xm via a switch S3. A positive terminal of the comparator 540 is connected to the Vp DAC 520 and an output terminal thereof is connected to the Vp data generating means 530. Storage means 550 shown in FIG. 4 corresponds to a memory provided within the controlling means 410*d* shown in FIG. 3 and stores the precharge voltage, specified according to an embodiment of the present invention, for each pixel circuit 110.

[B. Operation]

Figure 4:
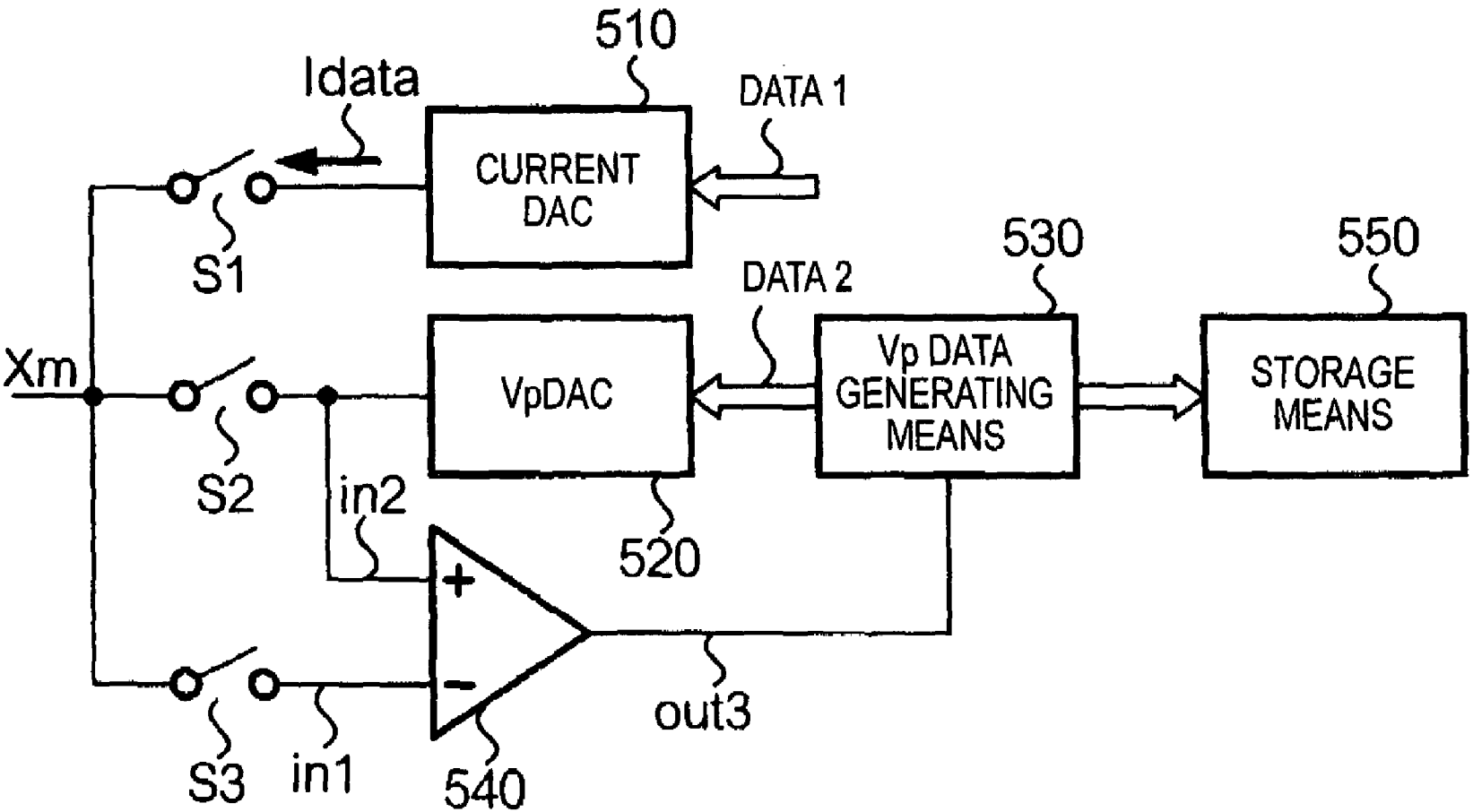
FIG. 4 is a detailed block diagram of the single line driver 410 according to the present invention.

The following description concerns the operation of the single line driver 410 having the structure shown in FIG. 4. In the operation described below, it is assumed that all pixel circuits connected to the single driver line 410 via the data line Xm are sequentially selected and a precharge voltage is specified with respect to each pixel circuit. In addition, it is also assumed that a pixel circuit with respect to which the precharge voltage is to be specified has already been selected.

Figure 5:
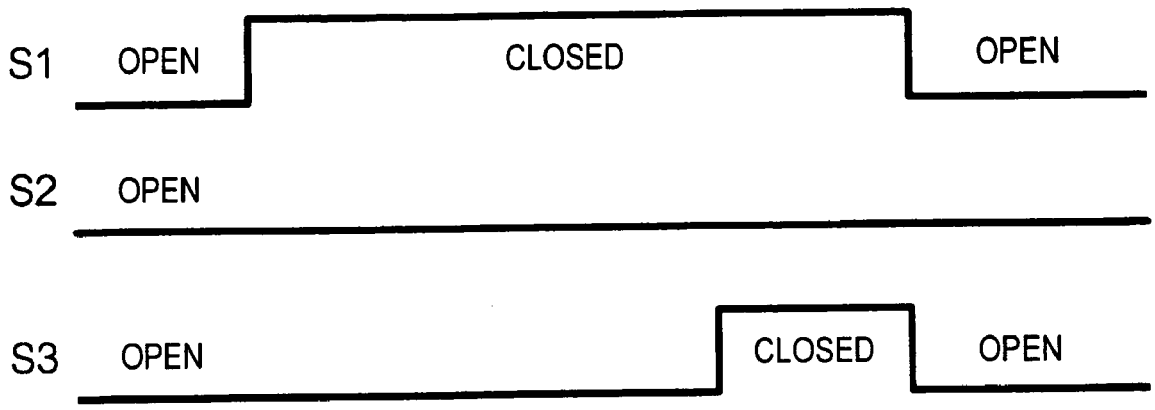
FIG. 5 is a timing chart illustrating the operation of the single line driver 410 according to the present invention.

FIG. 5 is a timing chart illustrating the operation of the switches S1, S2, and S3 during the calibration. As shown in FIG. 5, during the calibration, the switch S2 remains open. The controlling means 410*d* inputs data 1 corresponding to the calibration current to the current DAC 510. Next, the controlling means 410*d* closes the switch S1. As a result, the current DAC 510 outputs the calibration current Idata to the data line Xm.

Next, the controlling means 410*d* waits until programming to the pixel circuit 110 using the calibration current Idata is sufficiently performed and then closes the switch S3, as shown in FIG. 5. Then, a voltage appearing in the data line Xm is input to the negative terminal of the comparator 540. Next, the controlling means 410*d* causes the Vp data generating means 530 to generate data 2 corresponding to a voltage Vp and to output the generated data 2 to the Vp DAC 520. Upon receiving the data 2, the Vp DAC 520 outputs the voltage Vp. However, since the switch S2 is open, as shown in FIG. 5, the voltage Vp output from the Vp DAC 520 is applied to the positive terminal of the comparator 540.

Figure 6:
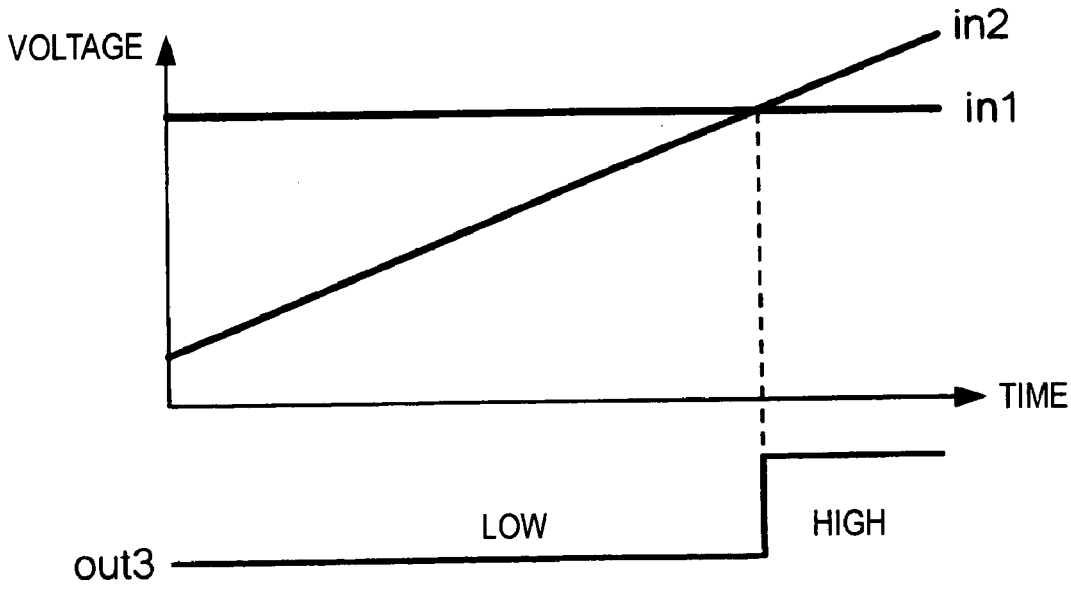
FIG. 6 illustrates the relationship between input and output signals of a comparator according to the present invention.

Meanwhile, until a signal at a "high" level is output from the output terminal of the comparator 540, the controlling means 410*d* controls the Vp data generating means 530 and changes the voltage Vp output from the Vp DAC 520. FIG. 6 illustrates a relationship among input signals in1 and in2 respectively to the negative and positive terminals of the comparator 540 and an output signal out3 from the output terminal of the comparator 540. As shown in FIG. 6, the comparator 540 outputs the output signal out3 at the "high" level when the input signal in2 to the positive terminal becomes greater than the input signal in1 to the negative terminal. As described above, the voltage appearing in the data line Xm has been applied to the negative terminal of the comparator 540 and the voltage Vp output from the Vp DAC 520 has been applied to the positive terminal thereof. Accordingly, the voltage Vp when the output signal out3 becomes the "high" level is identical to the voltage appearing in the data line Xm. The controlling means 410*d* specifies the voltage Vp measured through the above-described operation as the precharge voltage and stores the precharge voltage in the storage means 550 so as to correspond to the pixel circuit 110. Thereafter, the controlling means 410*d* opens the switches S1 and S3 and terminates the calibration for the pixel circuit 110.

Figure 7:
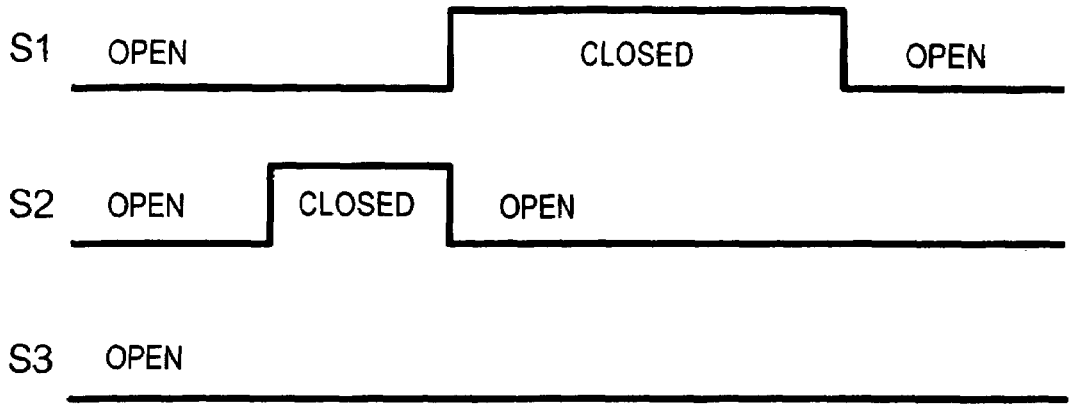
FIG. 7 is a timing chart illustrating the operation) of the single line driver 410 according to the present invention.

Thereafter, the controlling means 410*d* performs precharging using the precharge voltage Vp stored in the storage means. In detail, the controlling means 410*d* operates the switches S1 and S2, as shown in FIG. 7, and outputs data 2 corresponding to the precharge voltage Vp to the Vp data generating means 530 while the switch S2 is closed. As a result, the voltage Vp is applied to the data line Xm.

As described above, in the display apparatus according to the embodiment of the present invention, a precharge voltage specified for each pixel circuit is stored in storage means so as to correspond to the pixel circuit. For example, in factories before forwarding products, all pixel circuits may be driven to specify precharge voltages for the respective pixel circuits and the specified precharge voltages may be stored in the storage means to corresponded to the respective pixel circuits.

To accurately specify the precharge voltages, a longer programming time is required compared to when an image is typically displayed. However, in the embodiment of the present invention, since it is not necessary to specify the precharge voltages whenever an image is displayed, the time required to specify the precharge voltages is reduced. Alternatively, the distribution of precharge voltages for pixel circuits (for example, the gradient of the precharge voltages in the column or row direction) may be detected based on content stored in the storage means, and the precharge voltage for each pixel circuit may be gradually changed based on the detected distribution.

[C. Modifications]

In the above description, a best mode for carrying out the present invention has been described. However, various modifications may be made to the embodiment of the present invention described above as follows.

(C-1: Modification 1)

In the above-described embodiment, before forwarding products, pixel circuits are driven and precharge voltages are specified for the respective pixel circuits. In another embodiment, it is apparent that a display apparatus may perform the operation of specifying the precharge voltages at arbitrary timing after products are forwarded. For example, when electric power is supplied to the display apparatus, all pixel circuits in the display apparatus may be driven and precharge voltages for the respective pixel circuits may be specified. In this case, even when a driving transistor included in a pixel circuit is degraded over time and has a threshold voltage changed from that it had when the display apparatus was forwarded from a factory, a precharge voltage can be specified according to the changed threshold voltage.

Figure 8:
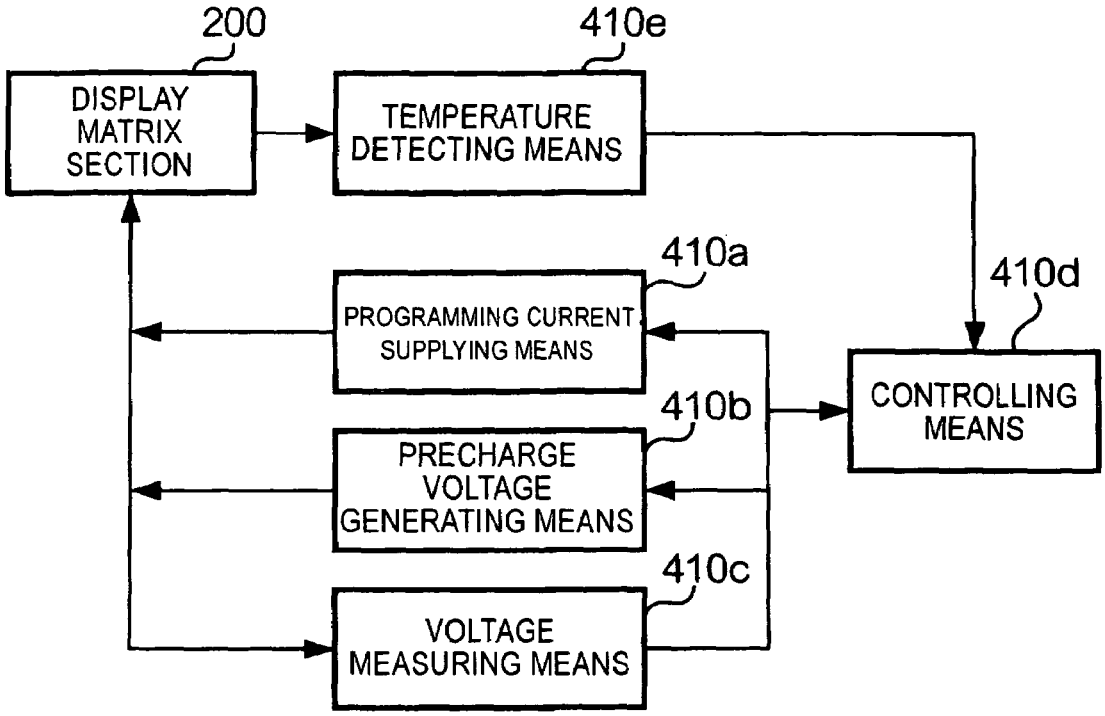
FIG. 8 illustrates a single line driver according to Modification 1 of the present invention.
Figure 9:
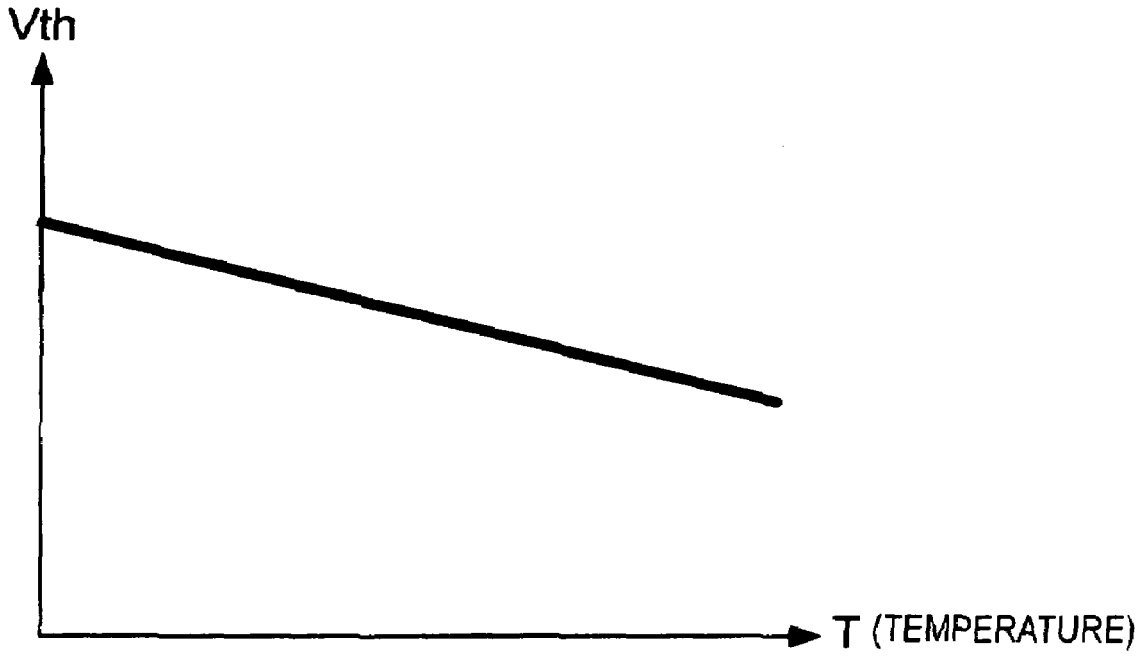
FIG. 9 is a view illustrating an example of a temperature-threshold voltage characteristic of a driving transistor.

In still another embodiment, the calibration may be performed with respect to each pixel circuit at any time while an image is displayed, and a precharge voltage for the pixel circuit may be specified whenever the calibration is performed. For example, as shown in FIG. 8, temperature detecting means 410*e* detecting the temperature of the display matrix section 200 may be further provided. In this case, when a temperature variation exceeding a predetermined value is detected by the temperature detecting means 410*e*, the calibration is performed and a precharge voltage is specified according to a current threshold voltage. Generally, when a pixel circuit is driven, the temperature of the pixel circuit increases, and the threshold voltage of a driving transistor changes, as shown in FIG. 9. However, even when the threshold voltage changes due to the increase in the temperature of the driving transistor, if the temperature detecting means 410*e* is provided, the precharge voltage corresponding to a current threshold voltage at the point of time can be specified.

(C-2: Modification 2)

In the above-described embodiment of the present invention, each of all pixel circuits is driven and a unique precharge voltage is specified for each pixel circuit, or precharge voltages are gradually changed based on the distribution of the precharge voltages for all pixel circuits. However, instead of performing the calibration on all pixel circuits included in the display matrix section 200, the calibration may be performed only on some of the pixel circuits and the distribution of precharge voltages for the some pixel circuits may be obtained. In an embodiment of the present invention, a single row is selected from the display matrix section 200. The calibration is performed only on pixel circuit in the selected row. The average (e.g., the arithmetic mean) of voltages appearing in all data lines is specified as a precharge voltage for all of the pixel circuits in the selected row. According to this embodiment, a calibration error included in a voltage appearing in a data line can be reduced.

Figure 10:
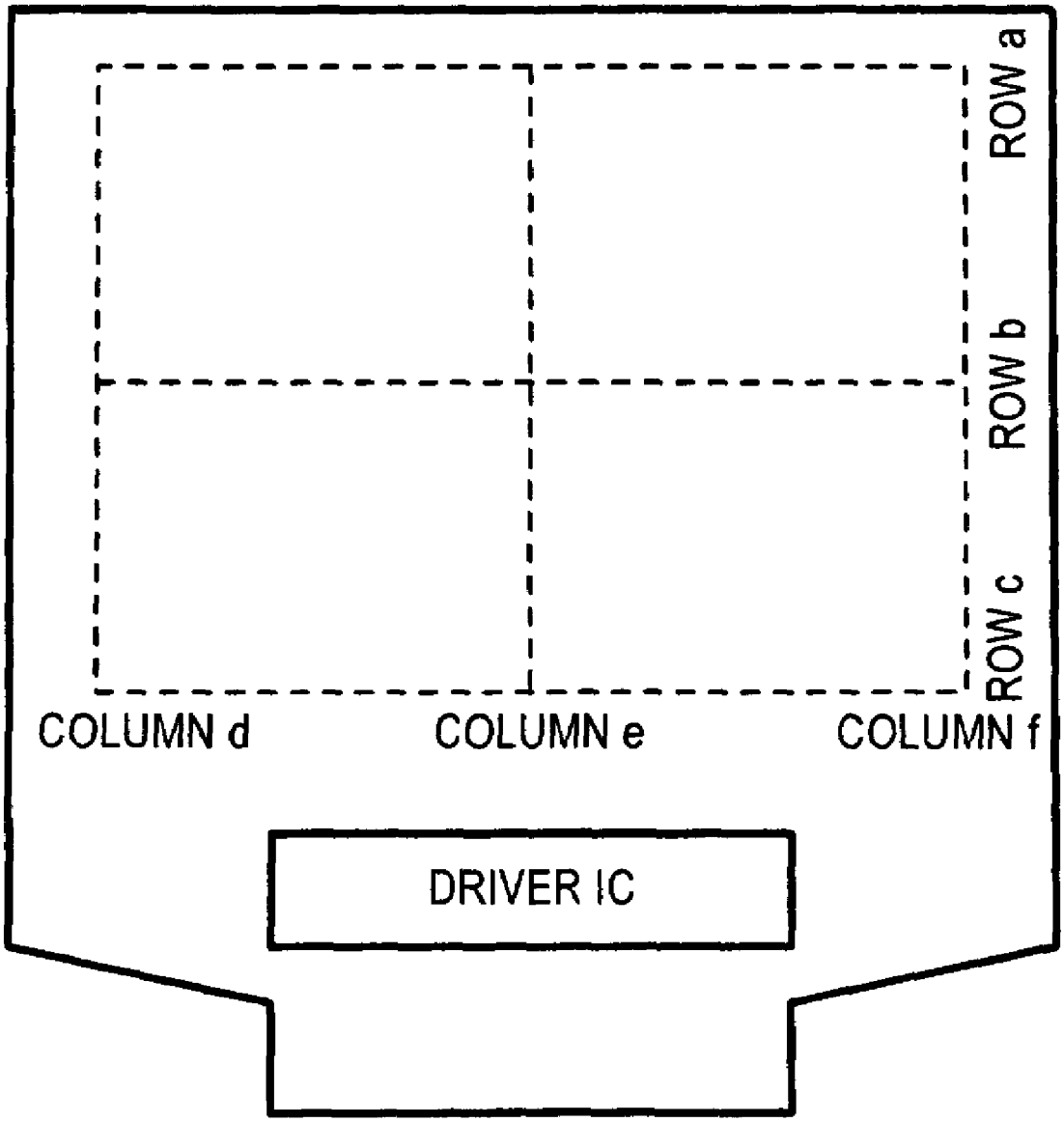
FIG. 10 is a view illustrating a method of specifying a precharge voltage according to Modification 2.

In another embodiment, as shown in FIG. 10, one or more rows (or columns) are selected from the display matrix section 200. The calibration is performed only on pixel circuits in the one or more selected rows (or columns). A precharge voltage is specified with respect to each of the pixel circuits in the one or more selected rows (or columns). Based on the distribution of precharge voltages, the precharge voltage is optimized. In this case, the time required for the calibration can be reduced compared to the case where the calibration is performed on all of the pixel circuits in the display matrix section 200. In addition, the storage capacity required for storing the specified precharge voltages can be reduced. When the calibration is performed in the row direction of the display matrix section 200 (i.e., when the calibration is performed on pixel circuits belonging to each of rows "a", "b", and "c" shown in FIG. 10), the precharge voltage gradient of the display matrix section 200 in the row direction can be observed and the calibration can be performed with respect to all of the data lines at one time. Alternatively, when the calibration is performed in the column direction of the display matrix section 200 (i.e., when the calibration is performed on pixel circuits belonging to each of column "d", "e", and "f" shown in FIG. 10), the precharge voltage gradient of the display matrix section 200 in the column direction can be observed. In addition, since a column to be subjected to the calibration is designated in advance, a load on a driver IC is decreased. As another alternative, the row-direction calibration may be combined with the column-direction calibration, and the distribution of precharge voltages may be obtained throughout the display matrix section 200.

(C-3: Modification 3)

Figure 11:
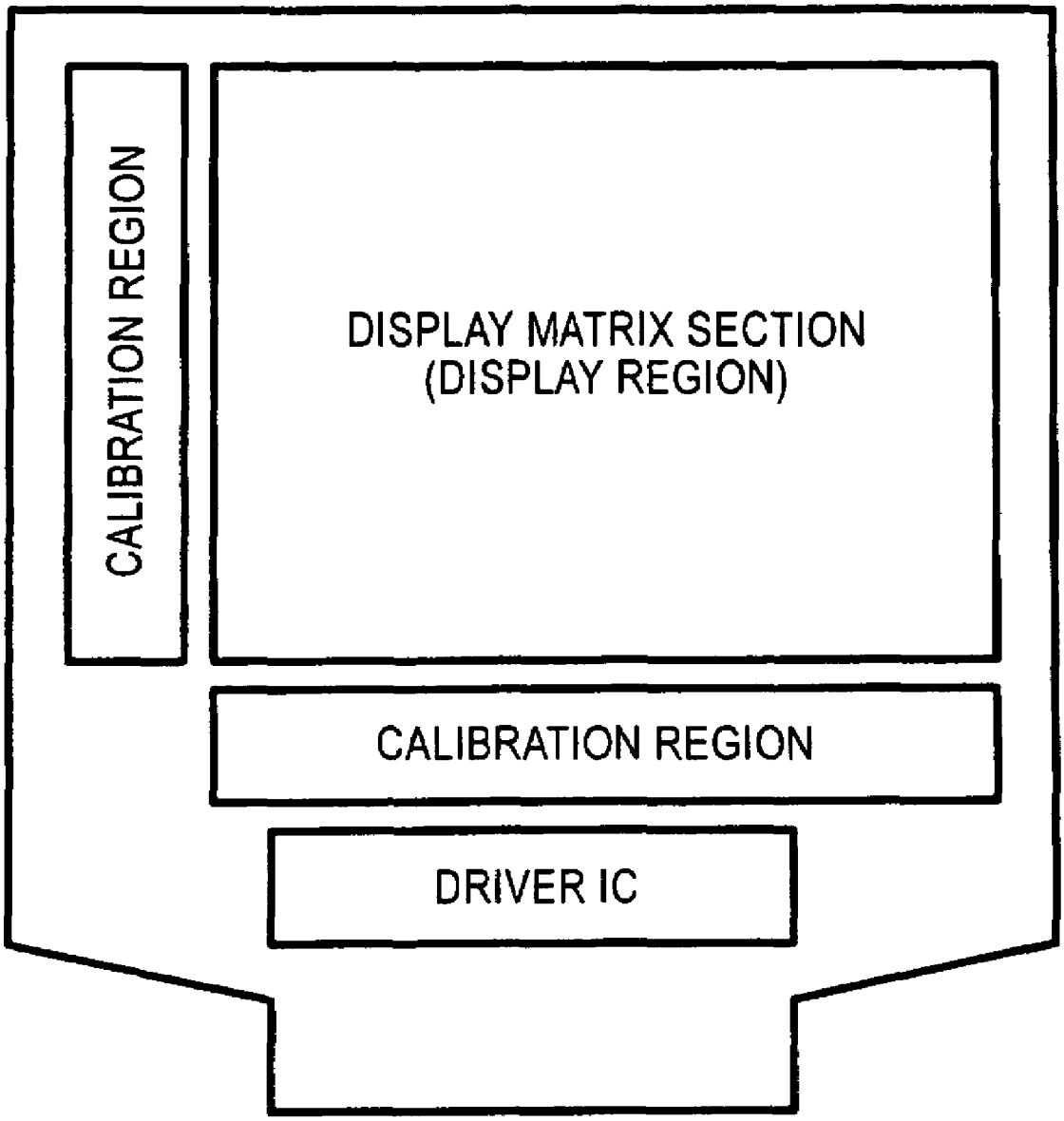
FIG. 11 is a view illustrating a method of specifying a precharge voltage according to Modification 3.

In the above-described embodiment, the pixel circuits 110 arranged in the display matrix section 200 are driven to specify precharge voltages. In another embodiment, pixel circuits for calibration (hereinafter, referred to as "calibration pixel circuits") may be provided outside the display matrix section 200 in addition to the pixel circuits 110 arranged in the display matrix section 200. In this case, the pixel circuits 110 arranged in the display matrix section 200 can be prevented from emitting light with a grayscale corresponding to the calibration current during the calibration. Accordingly, actual image display and calibration can be simultaneously performed without affecting the quality of a displayed image. In detail, a calibration region including calibration pixel circuits may be disposed on both or either of the left and right sides of the display matrix section 200 or may be disposed above and/or below the display matrix section 200. FIG. 11 shows an embodiment in which the calibration region is disposed on the left of and below the display matrix section 200. When the calibration region is disposed on both or either of the left and right sides of the display matrix section 200, all of the calibration pixel circuits are connected to one single line driver via one data line. Accordingly, during the calibration, only one single line driver is advantageously operated, and therefore, a load on the driver IC can be reduced.

Figure 12:
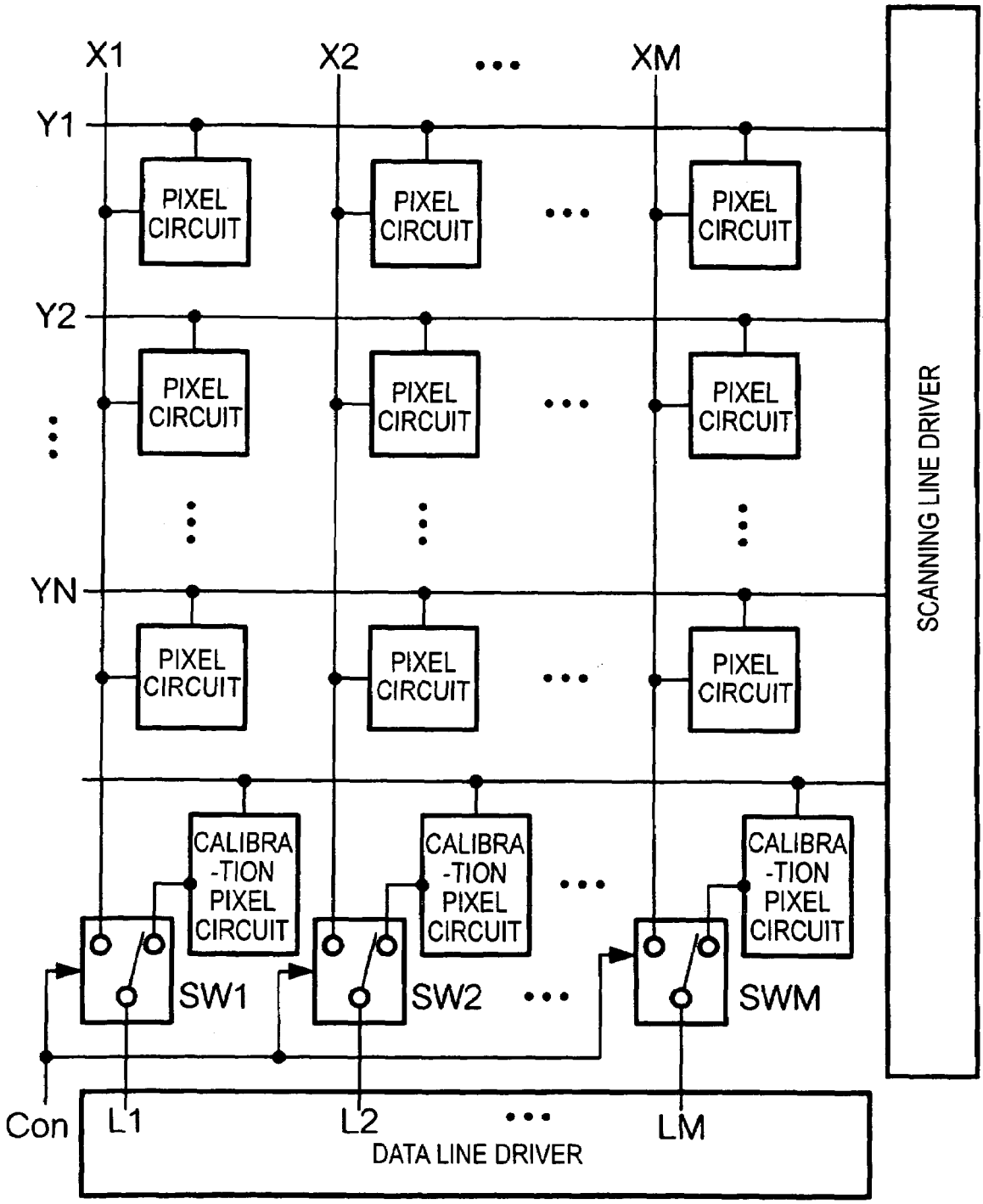
FIG. 12 is a view illustrating a display apparatus according to the Modification 3.
Figure 13:
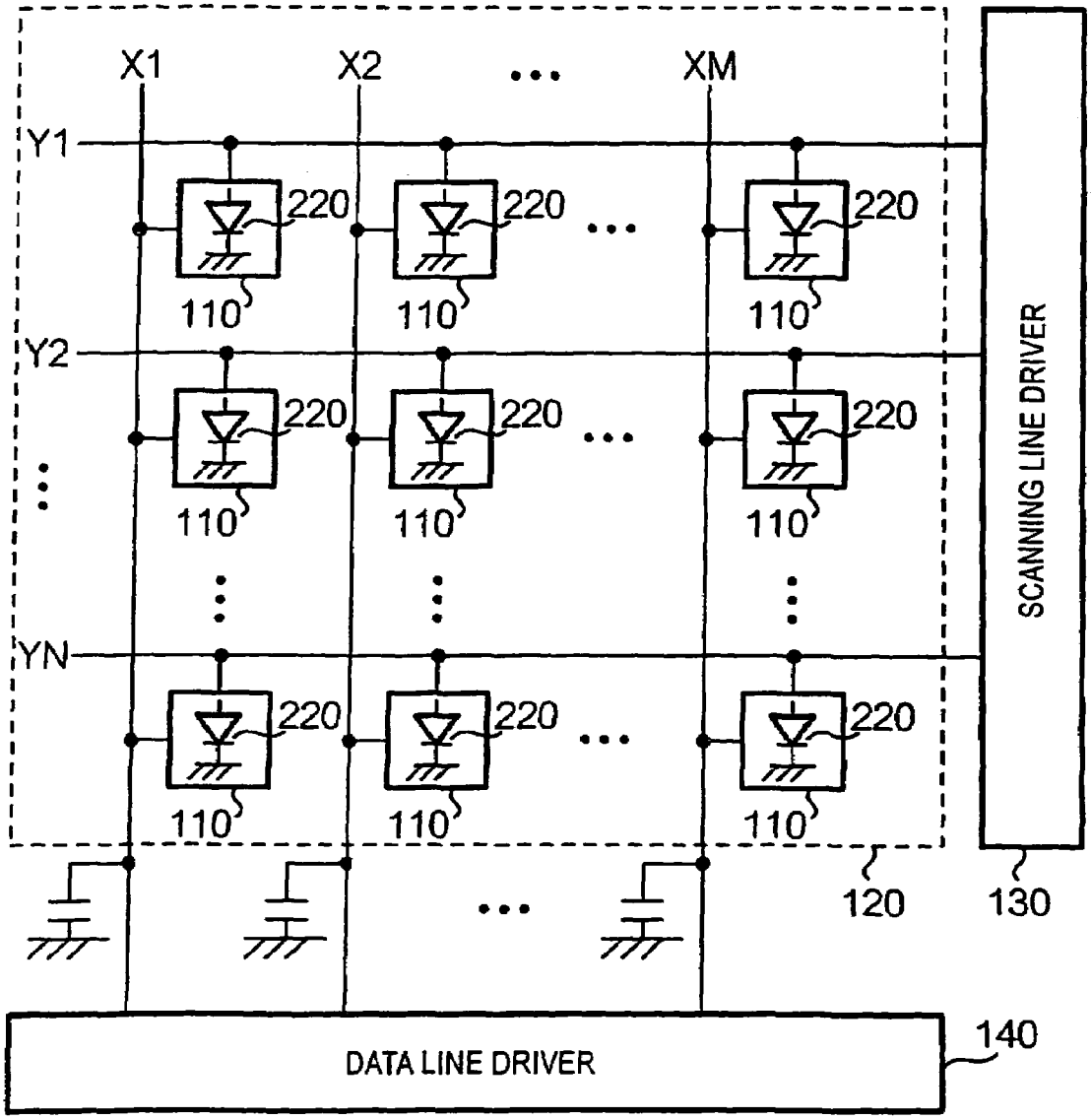
FIG. 13 is a block diagram of a conventional display apparatus using an organic electroluminescent (EL) element.

When the calibration region is disposed above and/or below the display matrix section 200, and particularly, when it is disposed below the display matrix section 200, effects described below can be achieved. FIG. 12 is a block diagram illustrating an example in which the calibration region is disposed below the display matrix section 200. Here, it will be noted that calibration pixel circuits are not connected to data lines Xm (m=1, 2, . . . , and M). A display apparatus shown in FIG. 12 includes switches SWm (m=1, 2, . . . , and M) switching output lines Lm (m=1, 2, . . . , and M) of a data line driver to the data lines Xm or calibration pixel circuits, respectively. Due to the switches SWm, the output lines Lm are connected to the calibration pixel circuits, respectively, during the calibration and connected to the data lines Xm, respectively, during the image display. Here, it will be noted that, in the display apparatus shown in FIG. 12, a path from the data line driver to each calibration pixel circuits is shortened. Accordingly, the long time required for programming current due to the floating capacity of the data lines Xm can be decreased, and therefore, the time required to specify a precharge voltage can be reduced.

In addition, in the aspect in which the above-described calibration region is provided, the calibration pixel circuits belonging to the calibration region may be dummy pixel circuits that do not include a light emission element. This is because the calibration pixel circuits are used only to specify a precharge voltage and are not used to display an image. Further, according to this aspect, during calibration, the calibration region is prevented from emitting light in accordance with the calibration current.

(C-4: Modification 4)

In the above-described embodiments, the present invention is applied to a display apparatus such as a display panel. When the present invention is applied to a large display panel, the precharging is performed using the specified precharge voltage so that the degradation of image quality caused by the aforementioned insufficient programming problem can be avoided. In addition, since the programming time is reduced, high-speed operation can be accomplished. However, the present invention is not restricted to the large display panel but can be applied to various kinds of electronic apparatus, e.g., mobile telephones, mobile personal computers, and digital cameras.

What is claimed is:

1. A display apparatus comprising:

a plurality of data lines;

a plurality of scanning lines;

a plurality of current drive type pixels provided so as to correspond to intersections of the plurality of data lines and the plurality of scanning lines;

supplying means which supplies a predetermined current via the plurality of data lines to the corresponding pixels;

voltage measuring means which measures voltages appearing in the data lines after the supplying means supplies the predetermined current;

specifying means which specifies precharge voltages as voltages to be applied to the data lines connected to the pixels before the internal state of the pixels corresponding to light emission grayscales is set, in accordance with the voltages measured by the voltage measuring means;

a display region in which the plurality of pixels is arranged in a matrix;

calibration pixels disposed outside the display region alongside of the display region; and switching means which selects either a first data line or a second data line for being connected to the supplying means, the first data line being connected to the pixels arranged in the display region to display an image, and the second data line being connected to the calibration pixels, wherein the supplying means supplies the predetermined current to the calibration pixels, wherein the specifying means specifies the precharge voltages for the corresponding calibration pixels and then, based on the distribution of the specified precharge voltages, optimizes the precharge voltages for the corresponding pixels arranged in the display region, and wherein the calibration pixels are disposed such that the length of the second data line is smaller than that of the first data line.

2. A display apparatus comprising:

a plurality of data lines;

a plurality of scanning lines;

a plurality of current drive type pixels provided so as to correspond to intersections of the plurality of data lines and the plurality of scanning lines;

supplying means which supplies a predetermined current via the plurality of data lines to the corresponding pixels;

voltage measuring means which measures voltages appearing in the data lines after the supplying means supplies the predetermined current;

specifying means which specifies precharge voltages as voltages to be applied to the data lines connected to the pixels before the internal state of the pixels corresponding to light emission grayscales is set, in accordance with the voltages measured by the voltage measuring means; and temperature detecting means which detects the temperature of the pixels, wherein the specifying means specifies the precharge voltages based on the voltages appearing in the data lines and the temperature detected by the temperature detecting means.

* * * * *